US012098608B2

(12) United States Patent
Casassa et al.

(10) Patent No.: US 12,098,608 B2
(45) Date of Patent: Sep. 24, 2024

(54) CUTTING TOOL AND CONTROLS FOR DOWNHOLE MECHANICAL SERVICES

(71) Applicant: Schlumberger Technology Corporation, Sugar Land, TX (US)

(72) Inventors: Joseph Matthew Casassa, Sugar Land, TX (US); Todor Sheiretov, Houston, TX (US); Joshua Wurtz, Houston, TX (US); Albert Dionisio, Sugar Land, TX (US); Robert Kyle Wiesenborn, Richmond, TX (US); Philip Stevenson, Sugar Land, TX (US); David Engel, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 38 days.

(21) Appl. No.: 17/809,056

(22) Filed: Jun. 27, 2022

(65) Prior Publication Data

US 2022/0412179 A1 Dec. 29, 2022

Related U.S. Application Data

(60) Provisional application No. 63/215,269, filed on Jun. 25, 2021.

(51) Int. Cl.
*E21B 29/00* (2006.01)
*E21B 47/06* (2012.01)

(52) U.S. Cl.
CPC ..... *E21B 29/002* (2013.01); *E21B 47/06* (2013.01)

(58) Field of Classification Search
CPC ..... E21B 29/002; E21B 47/00; B26D 3/163; B26D 3/164; B26D 3/166; B26D 3/167; B26D 3/168; B23D 21/14; B23D 21/45
(Continued)

(56) References Cited

U.S. PATENT DOCUMENTS 1,030,992 A 7/1912 Fulmer
1,785,419 A 12/1930 Moss
(Continued)

FOREIGN PATENT DOCUMENTS

CN 101012746 A 8/2007
CN 102102510 A 6/2011
(Continued)

OTHER PUBLICATIONS

Office Action issued in U.S. Appl. No. 17/823,757 dated May 2, 2023, 10 pages.
(Continued)

*Primary Examiner* — Matthew Troutman
*Assistant Examiner* — Patrick F Lambe
(74) *Attorney, Agent, or Firm* — Jeffrey D. Frantz

(57) ABSTRACT

Systems and methods presented herein provide for cutting in a borehole or casing. A cutting device can include a first arm having a cutting blade, wherein the cutting blade has side cutting teeth and an axis of rotation that is substantially at a right angle with respect to an axis of the tool body. The cutting device can also include a second arm with a bumper. The first and second arms articulate away from the elongate body in different directions to reduce vibrations while cutting. A control device can automate the cut based on hydraulic pressure measurements. Additionally, the cutting device can also be extended or rotated on a rotary index. The cutting device can rotate around a J slot, in an example.

20 Claims, 11 Drawing Sheets

(58) Field of Classification Search
USPC ..... 166/347
See application file for complete search history.

(56) References Cited

U.S. PATENT DOCUMENTS

| | | | | |
|---|---|---|---|---|
| 2,160,150 | A | 5/1939 | Jimerson et al. | |
| 2,500,402 | A | 3/1950 | Ernest | |
| 2,588,408 | A | 3/1952 | O'leary | |
| 2,713,992 | A | 7/1955 | Snyder | |
| 3,167,122 | A | 1/1965 | Lang | |
| 3,225,828 | A | 12/1965 | Wisenbaker et al. | |
| 4,325,436 | A | 4/1982 | Richter et al. | |
| 5,069,282 | A | 12/1991 | Taylor | |
| 5,170,843 | A | 12/1992 | Taylor | |
| 5,695,015 | A | 12/1997 | Barr et al. | |
| 5,706,896 | A | 1/1998 | Tubel et al. | |
| 5,785,120 | A | 7/1998 | Smalley et al. | |
| 5,832,998 | A * | 11/1998 | Decker | E21B 23/006 166/185 |
| 5,899,268 | A | 5/1999 | Lynde et al. | |
| 6,024,166 | A | 2/2000 | McGarian et al. | |
| 6,668,945 | B2 | 12/2003 | Ohmer | |
| 6,851,475 | B2 | 2/2005 | Simpson et al. | |
| 6,868,901 | B2 | 3/2005 | Mason et al. | |
| 7,575,056 | B2 | 8/2009 | Fuhst et al. | |
| 7,726,028 | B2 * | 6/2010 | Koch | B26D 3/001 30/92.5 |
| 7,909,100 | B2 | 3/2011 | Bryant, Jr. et al. | |
| 8,789,598 | B1 | 7/2014 | Mlcak et al. | |
| 10,683,719 | B2 | 6/2020 | Motland | |
| 2003/0234121 | A1 | 12/2003 | Taylor et al. | |
| 2005/0092494 | A1 | 5/2005 | McElroy et al. | |
| 2005/0092495 | A1 | 5/2005 | Evans | |
| 2005/0150693 | A1 | 7/2005 | Madden | |
| 2006/0169456 | A1 | 8/2006 | Evans | |
| 2006/0207796 | A1 | 9/2006 | Stewart | |
| 2007/0084637 | A1 | 4/2007 | Orban et al. | |
| 2007/0151732 | A1 | 7/2007 | Clemens et al. | |
| 2008/0087424 | A1 | 4/2008 | McLaughlin | |
| 2010/0258293 | A1 | 10/2010 | Lynde et al. | |
| 2011/0209872 | A1 | 9/2011 | McAfee et al. | |
| 2011/0297380 | A1 | 12/2011 | Alberty et al. | |
| 2012/0029702 | A1 | 2/2012 | Tverlid | |
| 2012/0043089 | A1 | 2/2012 | Hoffman et al. | |
| 2014/0124191 | A1 | 5/2014 | Hallundbæk | |
| 2014/0311729 | A1 | 10/2014 | Pasvandi | |
| 2014/0360784 | A1 | 12/2014 | Hunziker et al. | |
| 2015/0167394 | A1 * | 6/2015 | Xia | E21B 29/002 175/401 |
| 2015/0376966 | A1 * | 12/2015 | Balasubramanian | E21B 29/002 166/55.7 |
| 2016/0032696 | A1 | 2/2016 | Caccialupi et al. | |
| 2016/0130904 | A1 | 5/2016 | Andersen | |
| 2016/0138369 | A1 | 5/2016 | Tunget | |
| 2016/0258254 | A1 | 9/2016 | Guo et al. | |
| 2016/0319618 | A1 | 11/2016 | Motland | |
| 2017/0175475 | A1 | 6/2017 | Kartha et al. | |
| 2018/0003001 | A1 | 1/2018 | Pipchuk et al. | |
| 2019/0063214 | A1 * | 2/2019 | Castillo | E21B 17/1057 |
| 2020/0190951 | A1 | 6/2020 | Teurlay et al. | |
| 2020/0332615 | A1 * | 10/2020 | Wiesenborn | E21B 31/1135 |

FOREIGN PATENT DOCUMENTS

| | | | |
|---|---|---|---|
| CN | 106194158 | A | 6/2016 |
| CN | 106687242 | A | 5/2017 |
| EP | 2813665 | A1 | 12/2014 |
| RU | 2315177 | C1 | 1/2008 |
| WO | 2129350 | A | 5/1984 |
| WO | 03069116 | A1 | 8/2003 |
| WO | 2010085154 | A9 | 9/2010 |
| WO | 2012054445 | A2 | 4/2012 |
| WO | 2012074755 | A3 | 8/2012 |
| WO | 2013134629 | A1 | 9/2013 |
| WO | 2015112022 | A1 | 7/2015 |
| WO | 2016028155 | A1 | 2/2016 |
| WO | 2016085490 | A1 | 6/2016 |
| WO | 2020006333 | A1 | 1/2020 |

OTHER PUBLICATIONS

Office Action issued in U.S. Appl. No. 17/809,080 dated Jun. 23, 2023, 15 pages.
Rejection Decision issued in China Patent Application No. 201880075070.X dated Jun. 30, 2023, 17 pages.
Schlumberger, ReSOLVE iX Slot Cutter, Mar. 2021, 9 pages.
International Search Report and Written Opinion issued in PCT Application PCT/US2018/052171 dated Jan. 17, 2019 (18 pages).
International Search Report and Written Opinion issued in PCT Application PCT/US2018/052164 dated Mar. 6, 2019 (12 pages).
International Preliminary Report on patentability issued in PCT Application PCT/US2018/052171 dated Apr. 2, 2020 (15 pages).
International Preliminary Report on Patentability issued in PCT Application PCT/US2018/052164 dated Apr. 2, 2020 (8 pages).
Partial Supplementary Search Report of European Patent Application No. 18858532.7 dated May 18, 2021, 11 pages.
Extended Search Report of European Patent Application No. 18858532.7 dated Oct. 4, 2021, 10 pages.
Search Report of Chinese Patent Application No. 201880075070X dated Nov. 10, 2021, 7 pages with English Translation.
Substanative Exam issued in Saudi Arabian Patent Application No. 520411583 dated Mar. 29, 2022, 11 pages with English translation.
Second Office Action issued in Chinese Patent Application No. 201880075070.X datd Jun. 15, 2022, 9 pages with English translation.
Substantive Examination Report issued in Saudi Arabian Patent Application No. 520411583 dated Sep. 26, 2022, 10 pages with English translation.
Search Report and Written Opinion issued in the PCT Application PCT/US2022/035067 dated Oct. 18, 2022, 11 pages.
Office Action issued in U.S. Appl. No. 16/649,478 dated Oct. 18, 2021, 9 pages.
Office Action issued in U.S. Appl. No. 16/649,478 dated Apr. 4, 2022, 17 pages.
Notice of Allowance issued in U.S. Appl. No. 16/649,478 dated Sep. 23, 2022, 7 pages.
Search Report and Written Opinion issued in the PCT Application PCT/US2022/035083 dated Oct. 14, 2022, 12 pages.
Third Office Action issued in Chinese Patent Application No. 201880075070.X dated Oct. 21, 2022, 11 pages with English translation.
International Search Report and Written Opinion issued in the PCT Application PCT/US2022/042166 dated Dec. 9, 2022, 12 pages.

* cited by examiner

CUTTING TOOL AND CONTROLS FOR DOWNHOLE MECHANICAL SERVICES

This application claims priority to U.S. Provisional Patent Application No. 63/215,269, filed Jun. 25, 2021, the content of which is incorporated by reference herein in its entirety and for all purposes.

BACKGROUND

Downhole mechanical service tools allow for performing operations within a wellbore. Producing hydrocarbons from a wellbore drilled into a geological formation is a remarkably complex endeavor. In many situations, a casing or tubular (used interchangeably herein) may be disposed within the wellbore to assist in transporting hydrocarbons from within the geological formation to a collection facility at the surface of the wellbore. In other situations, the casing may be used to isolate and/or protect delicate systems within the casing from physical damage (e.g., abrasion, exposure to corrosive well bore fluids) due to contact with the geological formation.

The wellbore wall or a casing may require operation for a wide variety of reasons. For example, the casing may need to be cut to replace a section or to increase flow within the wellbore. There generally are times when it is desirable to gain access behind the casing in certain specific locations. For some applications, it may be advantageous to create a plurality of slots around the tubing circumference at substantially the same depth. For applications requiring such an arrangement of slots, a device is needed which can rotate the cutting tool around an axis parallel to the wellbore axis.

Prior U.S. Patent Pub. No. 2020/0332615, which is incorporated by reference, describes a mechanical service tool that includes a cutter. U.S. Pat. No. 7,909,100 discloses a tubing cutter run on coil tubing or pipe, but it is limited to horizontal cuts and can struggle to handle casings above a certain diameter.

Beyond the mechanical aspects of cutting slots in a casing, an additional need exists for optimization and automation of the cutting process from an instrumentation and control standpoint. Such a solution would enable real-time monitoring of slot cutter sensor data to give a clear indication of successful downhole slot cutting, provide for an accurate and repeatable process, and allow for automated control and adjustment to optimize efficiency of downhole cutting or machining operations.

SUMMARY

The examples described herein address a slot cutter and methods for using the slot cutter for performing downhole cutting operations. The examples include a slot cutter, which is also referred to as a cutting tool and a cutting device. The slot cutter can be assembled on a downhole tractor tool in one example, such as by replacing a first wheel with a rotating blade and a second wheel with a bumper. The bumper is also referred to as a pad herein.

The slot cutter assembly can include at least two arms with a blade on at least one of the arms. The blade can include side cutting teeth. This can ensure that the slot is wider than the body of the blade, reducing issues with the blade getting stuck in the slot that it cuts into the borehole or casing. The blades can have staggered or straight tooth alignments.

The blade can be a rotating cutter positioned on the first arm. The blade can be attached to a gearbox on a first arm, such as by removing a tractor wheel from the gearbox. The blade can rotate around an axis that is perpendicular to the borehole axis, in an example. The first arm can extend the blade towards the borehole wall, with the rotating cutting blade being moved longitudinally with respect to the axis of the wellbore (or axis of an elongate body of the tractor, which for this disclosure is considered part of the slot cutter).

The cutting blade can be solid carbide with or without a coating, in an example. Blades of different widths and diameters can be selected to control slot width and depth, based on the application. The depth of the cut can be from the outer diameter of the blade to a hub assembly towards the center of the blade, in an example. The hub assembly can allow the blade to attach to the tool at a gearbox in place of a wheel, in an example. The hub assembly can be keyed such that the tool can provide torque to the blade.

A second arm can be non-cutting. It instead can be equipped with a bumper, for example. The bumper can act as a grip pad. For example, a pad can replace a tractor wheel on the second arm to protect the gearbox on the second arm. For example, the pad can be clamped onto the gearbox arm with a set of screws. The pad can have a feature for gripping, such as serrated teeth, on the outer diameter of the pad. This can assist the cutting tool in remaining stationary within the borehole when performing a cut. The second arm can press the bumper into the borehole wall opposite the cut location to provide pressure for the cut. The grip feature can be selected according to the material of the tubing in the borehole.

The cutting tool can further comprise one or more collars. A collar can help protect the rotating blade from damage when the cutting tool is being moved within the well borehole. To do this, the collar can protrude farther than the blade when the first arm and blade are retracted. The collar can wrap around the elongate body of the cutting tool. Alternatively, the collar can include a protrusion that aligns with the first arm. The collar can be placed above the first arm, below the first arm, or both. The collar can have grooves in the outer diameter surface to allow debris such as fluid and metal cuttings to pass. This can prevent debris buildup near the blade that could hinder the cutting process. The collar can be clamped to the elongate tool body with a set of screws, in an example.

The cutting blade hub assembly can include components that connect the cutting blade to the gearbox by compressing the blade between two metal plates. The two metal plates can be attached to the gearbox using one or more screws. One of the plates can be a drive plate, and the other a cover plate, with the blade sandwiched between.

The drive plate can include a feature on a back side that mates to the gearbox drive. The drive plate front side can have a machined arbor to keep the blade centralized on the hub. The front side can also include a keyed feature that mates with the inner diameter of the cutting blade to transmit torque to the blade. The hub cover plate can provide clamping force to keep the blade positioned on the drive plate.

A control device can be used to execute a cut with the slot cutter. A force can be applied to extend the cut perpendicular to the axis of the tool (or wellbore axis) in the uphole or downhole directions. The force can be delivered by a linear actuator in one example. The control device can also rotate the slot cutter. For example, a rotary actuator can be driven and can report an angular position measurement that the control device uses to index the slot cutter.

The control device can rely on measurements from various sensors on the slot cutter. For example, the control device can read measurements from a linear potentiometer or other sensor that measures linear displacement. The displacement can be a measure of the radial progress of a blade through the casing and be used in determining a rate of penetration. These determinations can be displayed in a graphical user interface ("GUI") to a user, in one example. The control device can also make other inferences, such as producing an alert regarding blade wear when the blade is cutting slower than a threshold.

The control unit can also automate the cut in an example. This can include repeatedly powering a hydraulic pump each time pressure drops below a threshold. However, once pressure stops dropping, or is constant, this can indicate that the hub or gearbox is bottomed out and the maximum cut depth is reached, verifying the cut is complete. In one example, the various pressure measurements and current to the hydraulic pump can be used to train a machine learning model. The model can then be used to efficiently distribute current to the hydraulic pump during the cut and determine when the cut is complete.

It is to be understood that both the foregoing general description and the following detailed description are exemplary and explanatory only and are not restrictive of the embodiments, as claimed.

BRIEF DESCRIPTION OF THE DRAWINGS

The accompanying drawings, which are incorporated in and constitute a part of this disclosure, illustrate various embodiments and aspects of the present invention. In the drawings.

DESCRIPTION OF THE EXAMPLES

Reference will now be made in detail to the present exemplary examples, including examples illustrated in the accompanying drawings. Wherever possible, the same reference numbers will be used throughout the drawings to refer to the same or like parts. The described examples are non-limiting.

Figure 1:
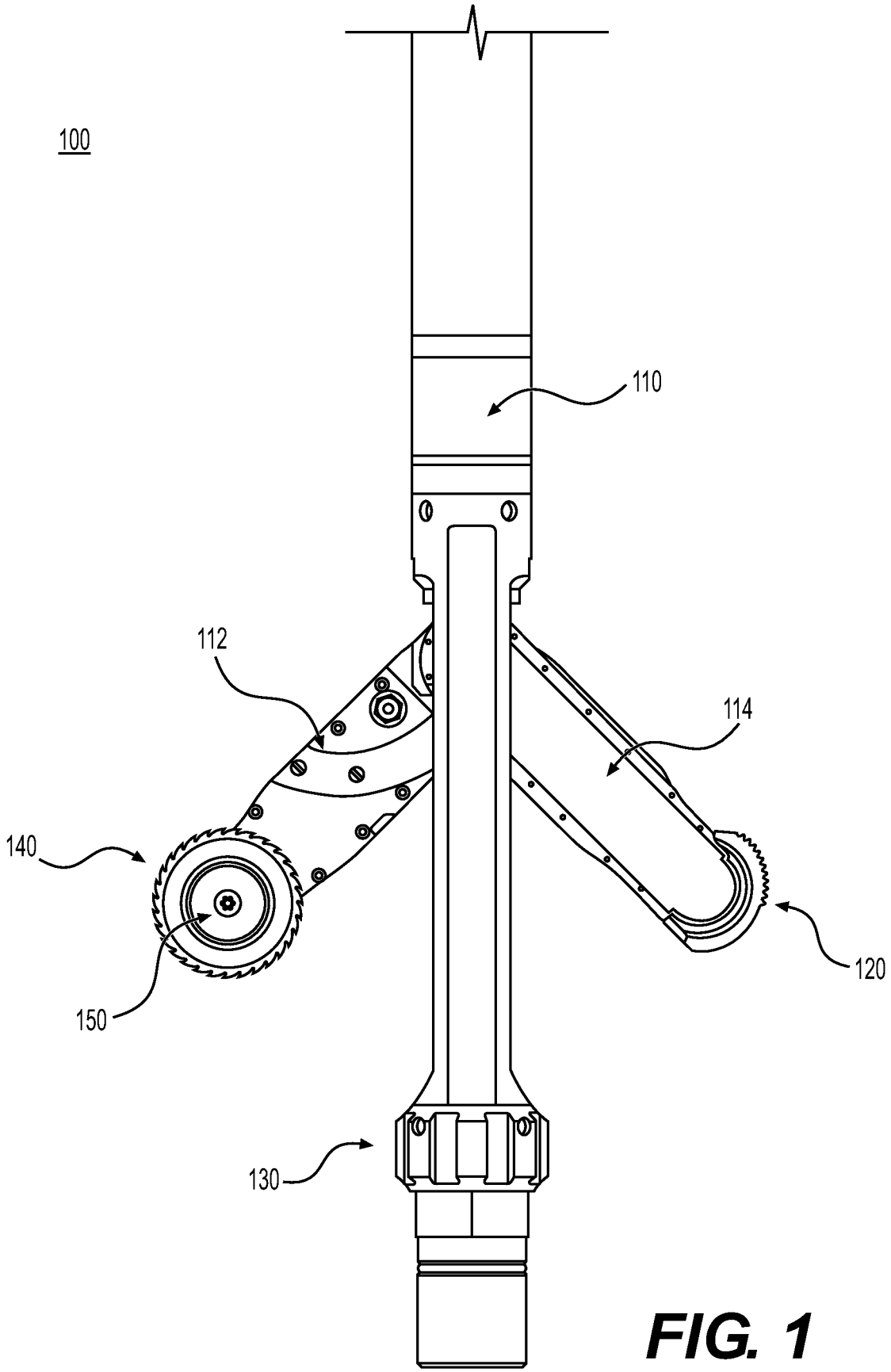
FIG. 1 is a side view of an example cutting device.

FIG. 1 is a side view of an example cutting device 100. The cutting device 100 can include at least one rotating blade 140 on a first arm 112 of an elongate tractor tool body 110. The blade 140 can lock onto a gearbox of the first arm 112 using a locking hub 150.

A second arm 114 can be equipped with a bumper 120. The first and second arms 112, 114 can articulate in opposite directions in an example. This can allow the bumper 120 to brace the cutting device 100 on one side of the borehole while the blade 140 cuts on the other side. This can reduce vibrations and errant cuts, leading to more predictable performance and less damage to the device 100. The second arm 114 can act as a radial anchoring and feed arm opposite of the cutter arm 112. The extra pressure can help complete the cut. In one example, this is achieved by positioning the second arm 114 opposite of the cutter arm 112, such that the two arms cause contact on opposing sides of the wellbore. This increases the stiffness of the cutting system and minimizes vibrations, which if present may lead to the cutting tool 100 breaking.

The bumper 120 can include a hardened anchor pad and can be used instead of a wheel on the tractor body to ensure less slippage. The pad can be made from material that is harder than the wellbore wall casing. For example, hardened stainless steel can be used for the bumper 120. In addition, the pad has protrusions, which can partially or fully penetrate the casing wall and prevent any slippage between the tool 100 and the well bore.

To further prevent damage, one or more collars 130 can be installed on the elongate body 110. The collar 130 can protrude further than the blade 140 when the first arm 112 is fully retracted inwards to the body 110. Multiple collars 130 can be used in one example, such as one below the blade 140 (e.g., illustrated collar 130) and one above the blade 140 (not illustrated). The collars 130 can protect the blade 140 when the tool 100 is moved in the well, such as by preventing the blade 140 from contacting the borehole wall while the tool 100 is being moved.

In one example, the cutting tool 100 can accept different sizes of cutting blades 140. These can be selected based on the borehole size and the wall thickness of the tubular that has to be cut. In some instances, the diameter of the cutting blade may exceed the diameter of the tool body 110. In these cases, the cutting blades 140 could potentially get damaged while moving the tool, but the collar 130 can prevent that by extending laterally further than the retracted blade 140 would extend.

In one example, the slot cutter 100 utilizes gearbox arms 112, 114 on the tractor tool body 110 by removing the wheels and installing the slot cutter kit. This can involve installing the hub assembly 150 with a carbide side cutting blade 140 on one gear box, the bumper grip pad 120 on the opposite gearbox, and the tool body collar 130 above, below, or above and below the gear box assemblies. The tool 100 could also be arranged with a cutting blade on both arms 112, 114 or with a false arm on one side to allow thicker blades to be installed.

Slot cutter kits can be installed on all gearboxes or just selected gearboxes with the ability to run several tool strings in tandem. The tool string can be configured by placing an anchor above or below the tool string or ran with no anchor. While utilizing an anchor it can be operated on an independent hydraulic bus, shared hydraulic bus, or shared hydraulic bus with isolation valve. Slots can be cut simultaneously or independently. The slots can be cut longitudinally along the tubing by rotating the blades and opening the gearbox arms. The length of the slot cut can be determined by either the diameter of the cutting blade versus the side wall thickness of the tubing or by elongating the slots by using a mechanical device to move the tool string forwards or backwards. This can also be done by using the wireline cable to pull the tool string with the cutting blades in gauged in the tubing. The cut completion can be recognized when the gearbox with the blade reaches the inner diameter of the tubing, at this point you will be able to increase arm pressure and see little to no increase in torque this will indicate the blades are fully engaged.

Figure 2:
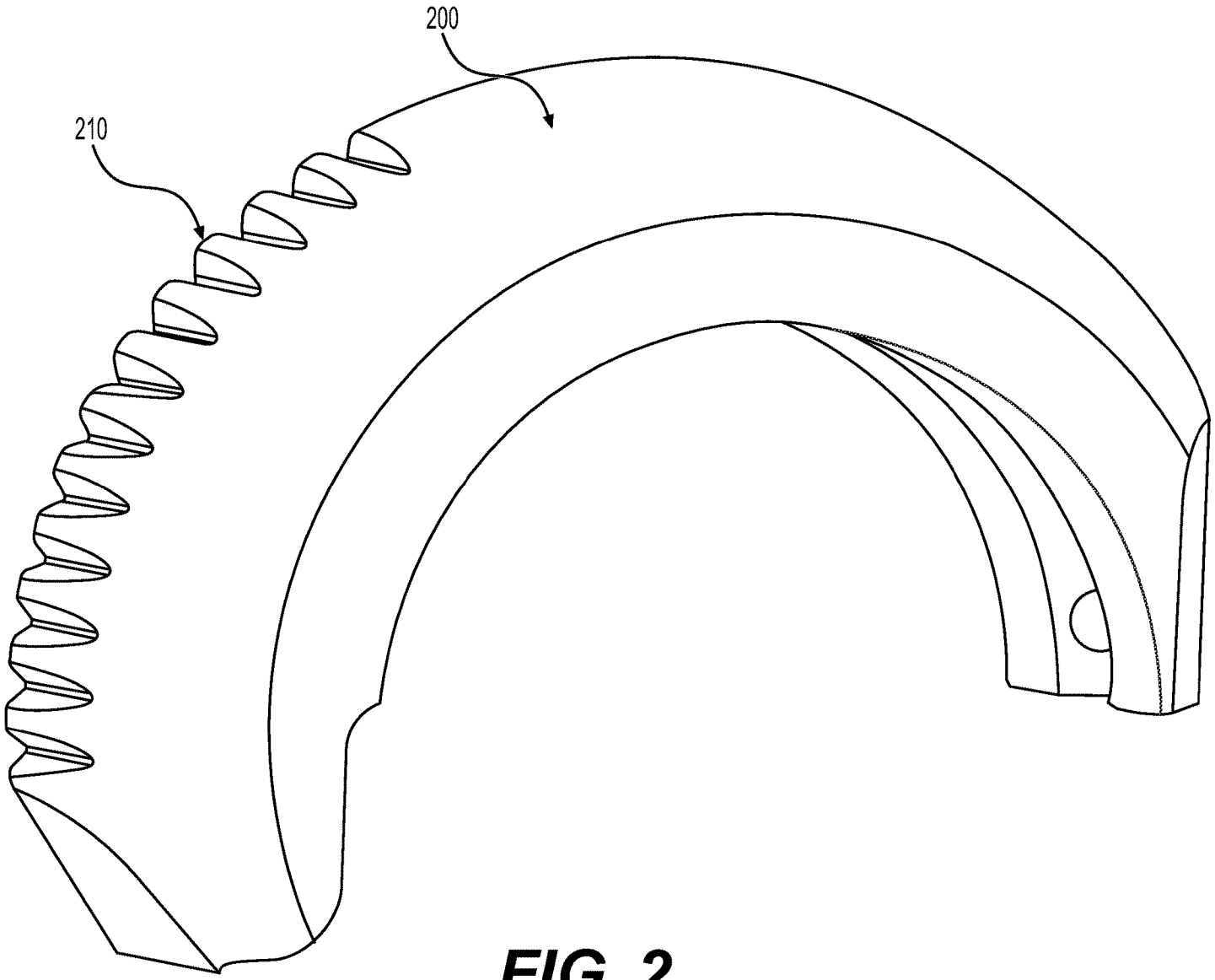
FIG. 2 is a perspective view of an example grip pad for use on the cutting device.

FIG. 2 is an example perspective view of a grip pad 200 (i.e., bumper) for use on the cutting device 100. A gripping feature 210 can be included that digs into the wall of the casing to prevent movement and reduce vibration while cutting. In the illustrated example, serrated teeth are used as the gripping feature 210. However, different gripping features can be chosen depending on the tubing material (casing) used inside the well. In one example, the bumper is made from hardened stainless steel, such as type 440 stainless steel.

Figure 3:
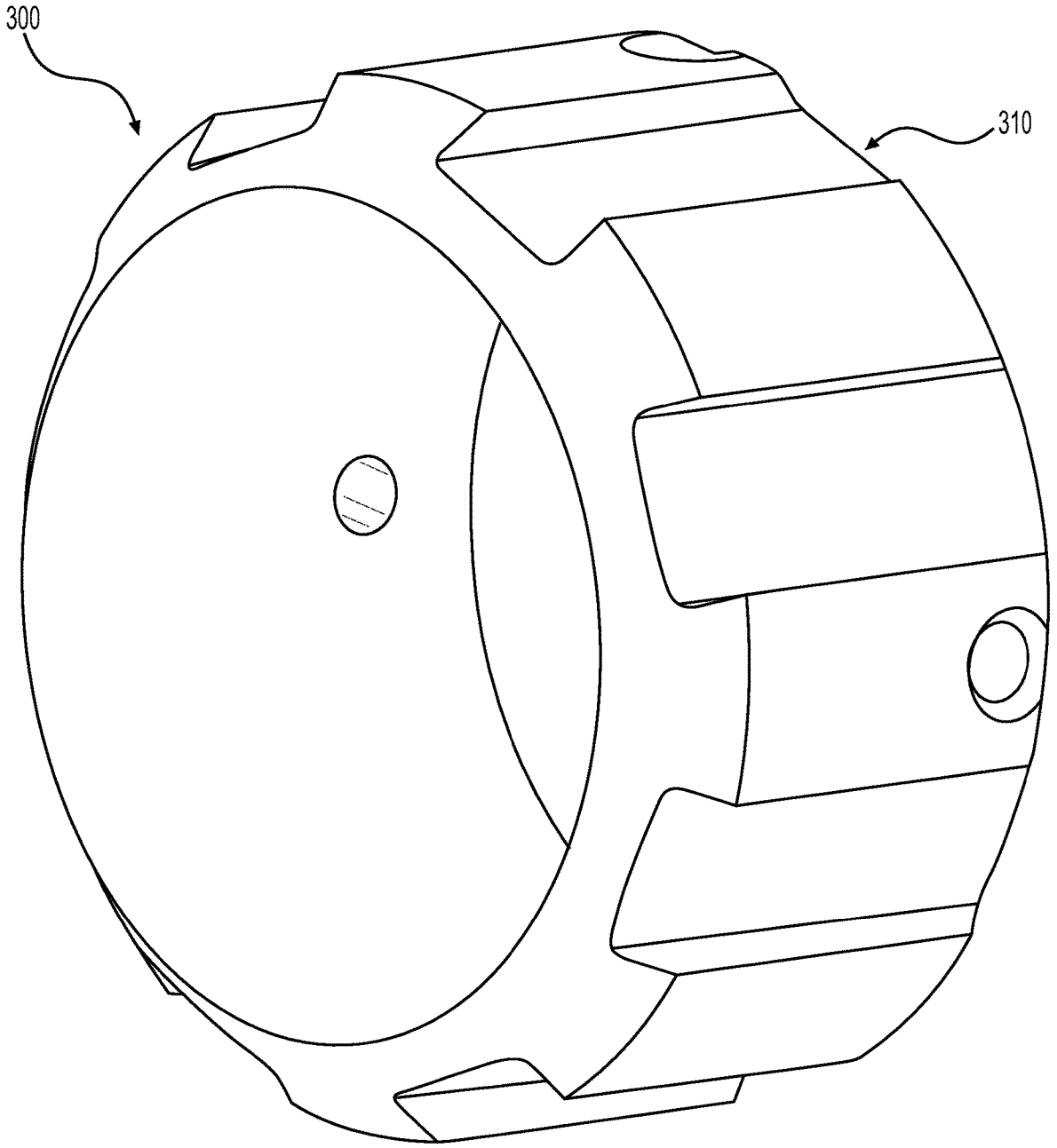
FIG. 3 is a perspective view of an example collar for use on the cutting device.

FIG. 3 is an example perspective view of a collar 300 for use with the cutting device 100. The collar 300 can protect the cutting blades as previously discussed. The collar 300 can also have grooves 310 that allow for debris evacuation. The raised portion can press against the tubing material of the well but the grooves 310 can still act as openings for liquid or shavings. The collar 300 can be clamped onto the tool body using screws, in an example.

Figure 4:
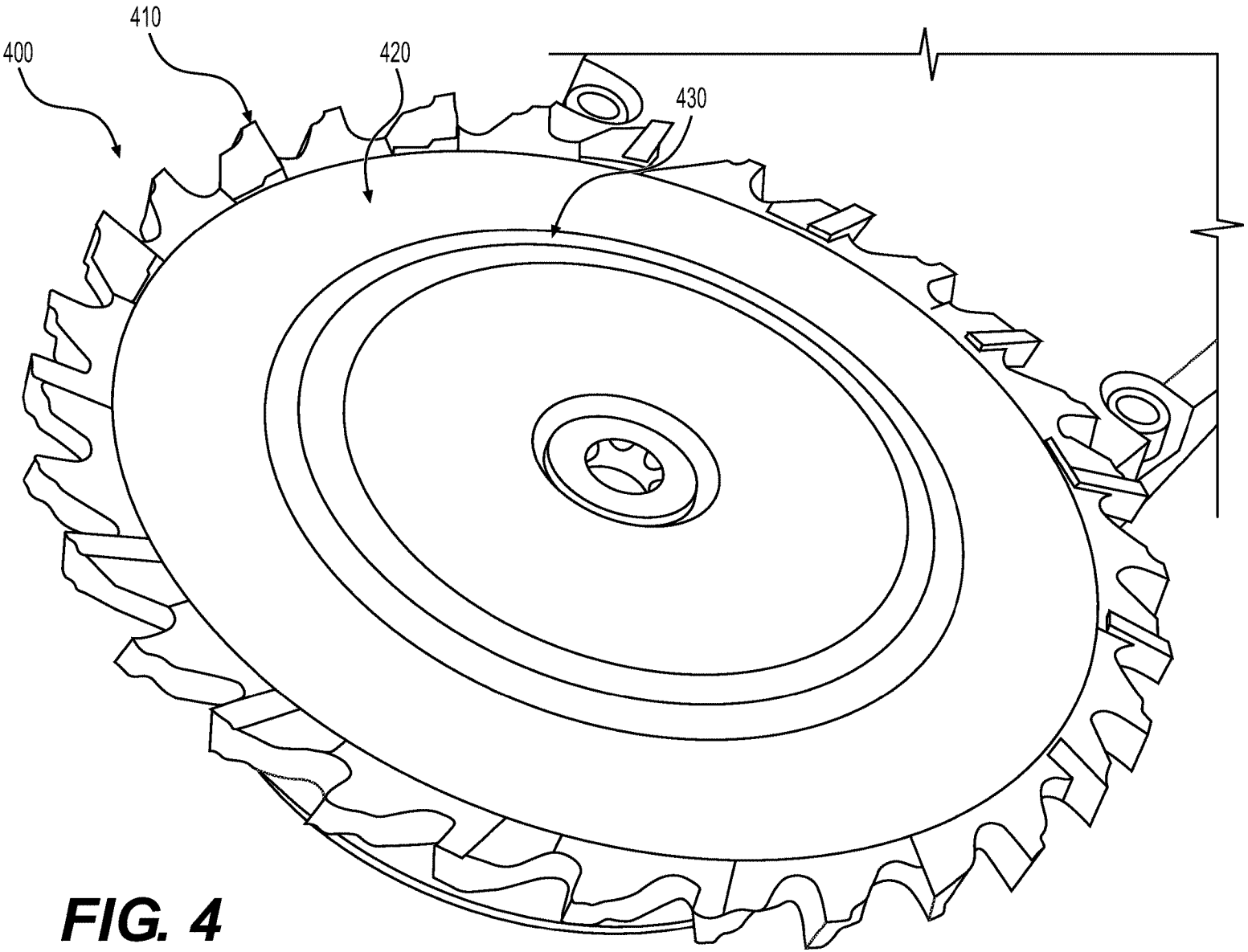
FIG. 4 is a perspective view of an example blade with a side cutting feature for use on the cutting device.

FIG. 4 is an example perspective view of a rotary blade 400 with a side cutting feature 410 for use on the cutting device 100. The side cutting feature 410 can include teeth that protrude sideways, or outwardly, from the side wall 420 of the blade 400. This can provide some extra width to the cut such that the blade 400 is less likely to get stuck during the cut. The blade can be attached to the arm of the tool using a hub assembly 430.

Figure 5:
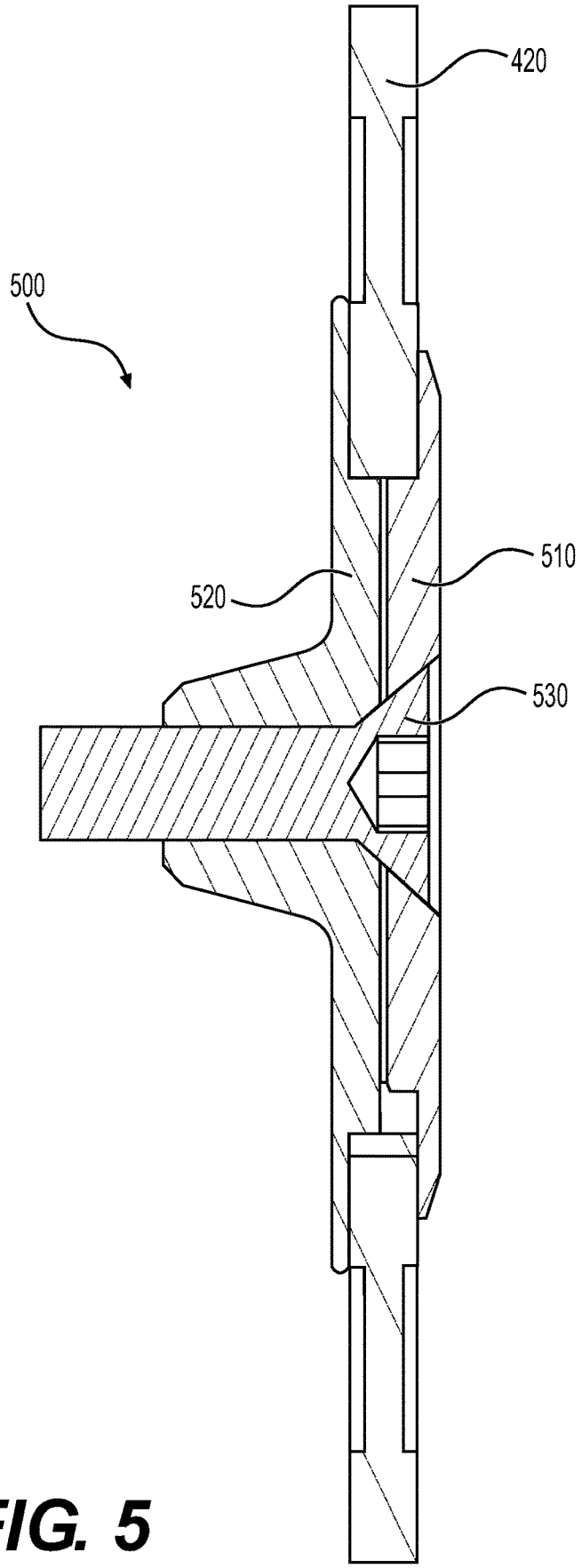
FIG. 5 is a cross-sectional side view of an example hub assembly of the cutting device.

FIG. 5 is an example cross-sectional side view of a hub assembly 500 of the cutting device 100. The cutting blade hub assembly 500 can include components that connect the cutting blade 420 to the gearbox by compressing the blade between two metal plates 510, 520. The two metal plates 510, 520 can be attached to the gearbox using one or more screws 530. One of the plates can be a drive plate 520, and the other a cover plate 510, with the blade 420 sandwiched between them and secured using the screw 530.

Figure 6:
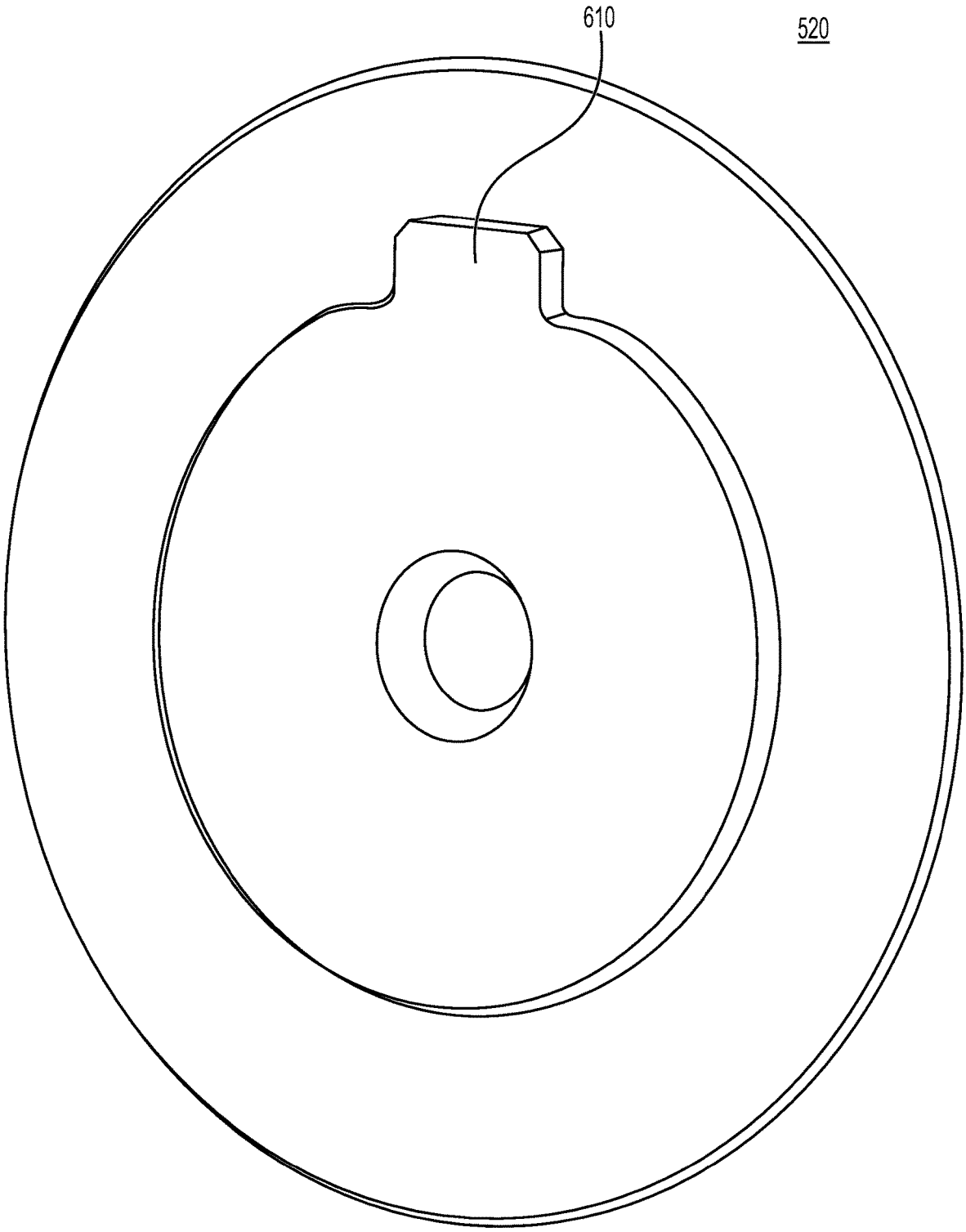
FIG. 6 is a perspective view of an example hub for use with the cutting device.

FIG. 6 is an example perspective view of a hub drive plate 520 for use with the cutting device 100. The drive plate 520 can include a feature on a back side that mates to the gearbox drive (shown in FIG. 8). The drive plate 520 front side can have a machined arbor to keep the blade centralized on the hub. The front side can also include a keyed feature 610 that mates with the inner diameter of the cutting blade 420 to transmit torque to the blade.

Figure 7:
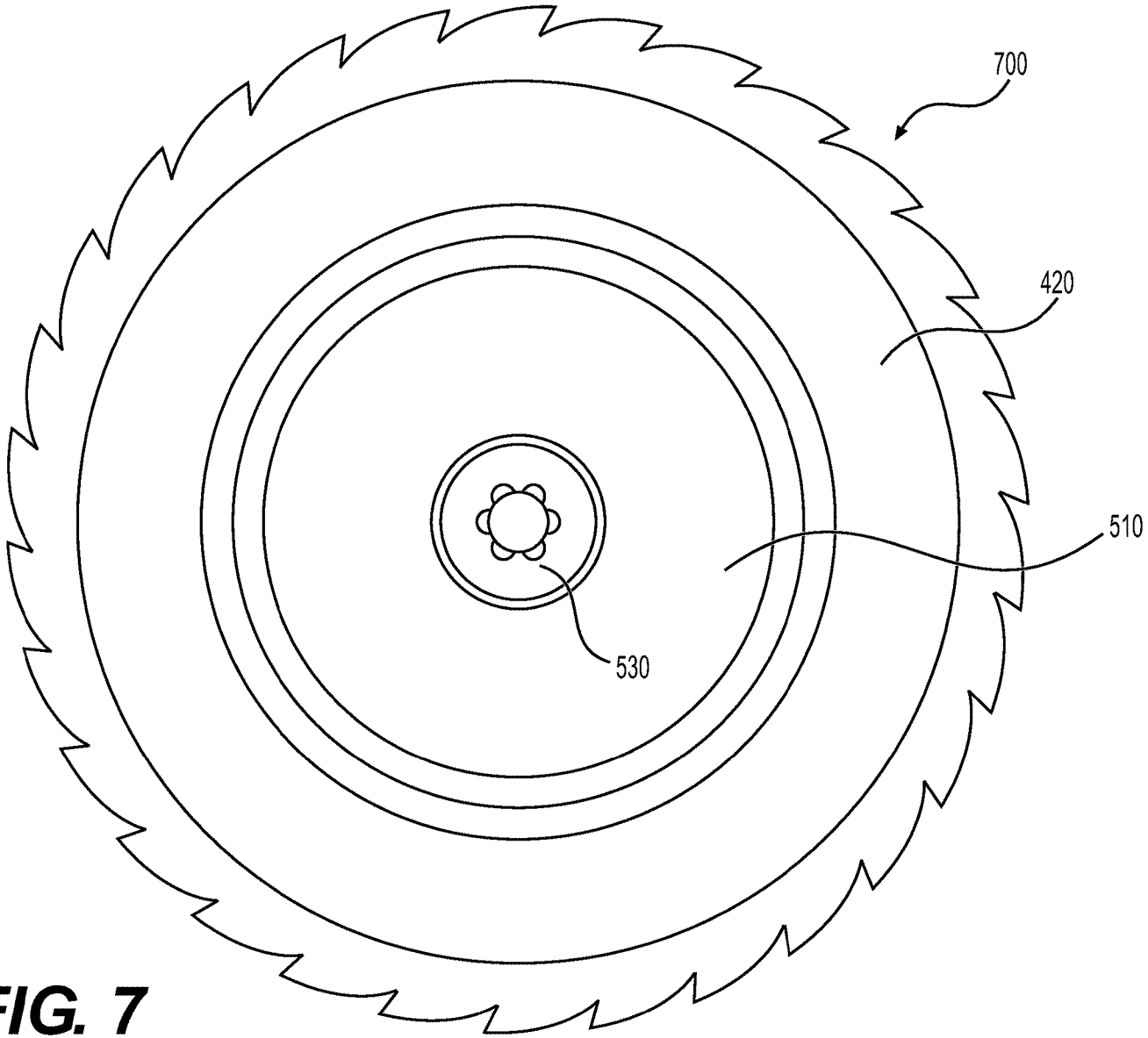
FIG. 7 is a front view of an example hub assembly for use with the cutting device.

FIG. 7 is an example front view of a hub assembly 700 for use with the cutting device 100. In this drawing, the hub assembly includes a blade 420 installed between a drive plate 520 (not shown) and a cover plate 510 and secured with a screw 530.

Figure 8:
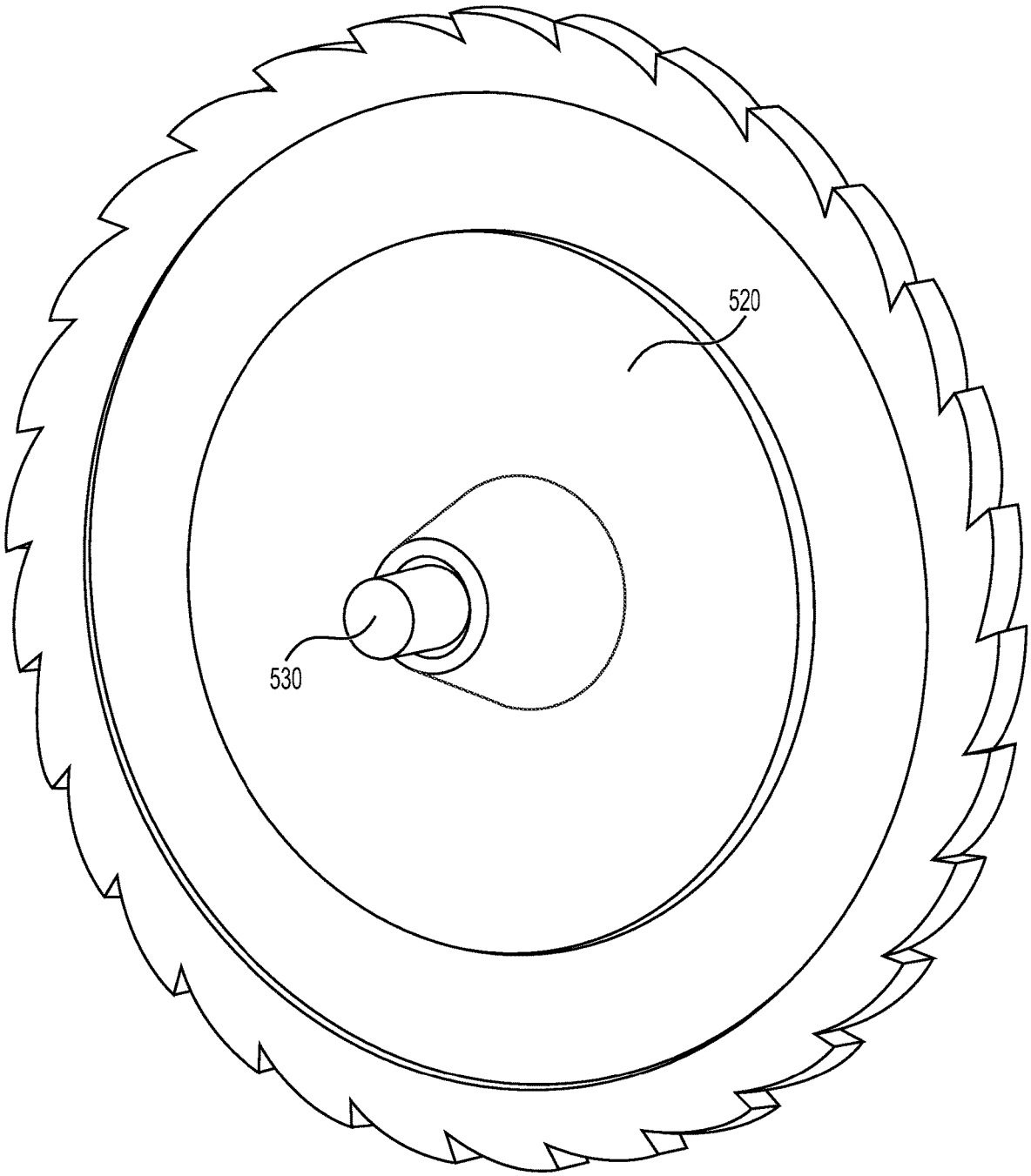
FIG. 8 is a back view of an example hub assembly for use with the cutting device.

FIG. 8 is an example back view of a hub assembly 700 for use with the cutting device 100. The hub drive plate 520 can provide clamping force by way of a screw 530 to keep the blade 420 positioned on the drive plate 520.

Figure 9:
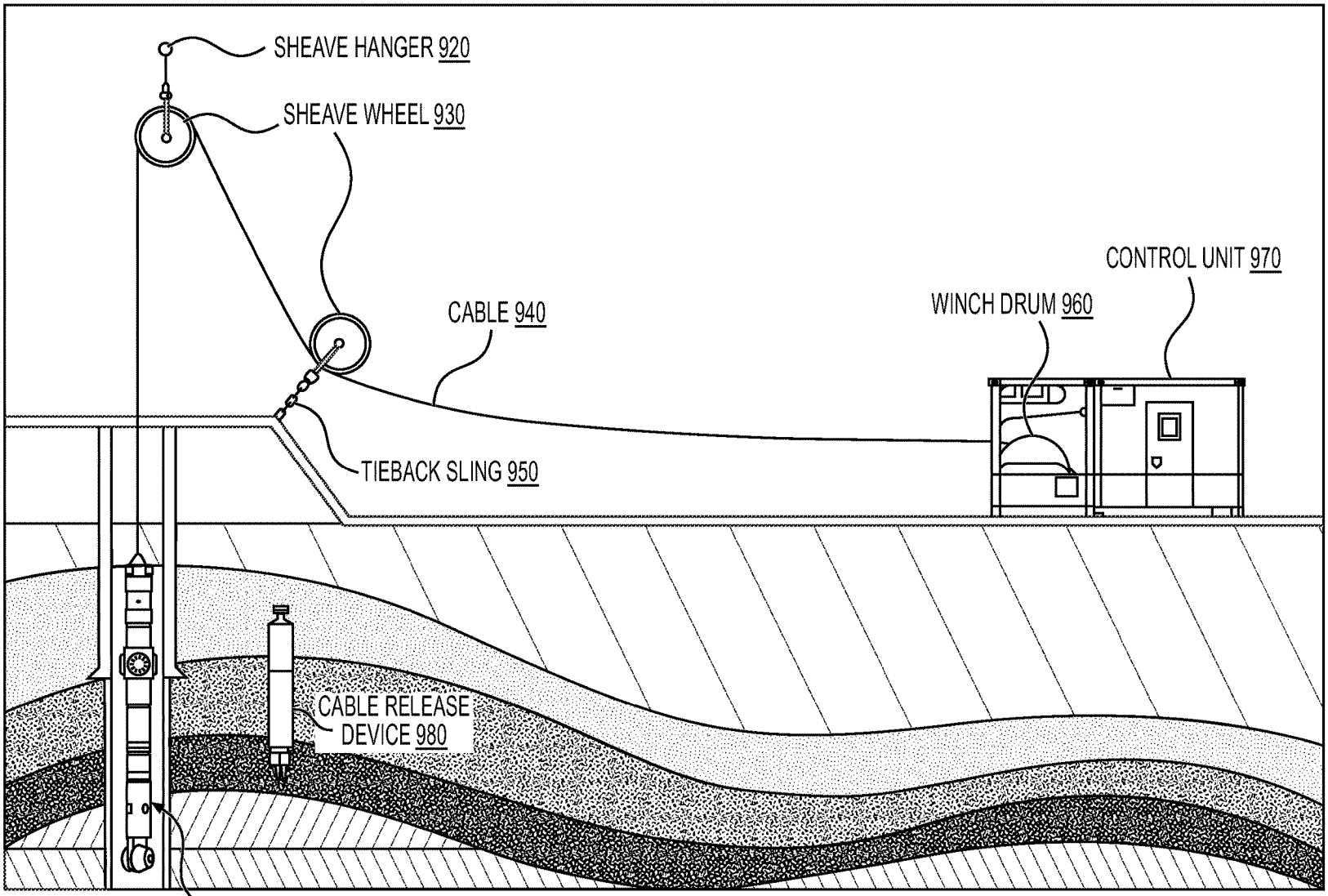
FIG. 9 is a diagram of an example system that uses the cutting device.

FIG. 9 is a diagram of an example system that uses the cutting device 910. The system can include a control unit 970 (also referred to herein as a control device) that controls various aspects of the operation. For example, it can control a winch drum 960 that can manipulate a cable 940, such as by winding the cable 940 around the drum or unwinding the cable 940 from the drum to allow the tool 910 to descend within a borehole. The cable 940 can interface with one or more sheave wheels 930. In this example, one sheave wheel 930 is attached to a sheave hanger 920 above the borehole, while another sheave wheel 930 is attached to a tieback sling 950. The cable 940 can attach to the tool 910 using a cable release device 980, which can allow for easy release of the cable 940 from the tool 910 when necessary.

The control device 970 can be any processor-enabled device, such as a workstation, laptop, tablet, or phone. The control device 970 can include a GUI for user interaction and can be located remotely from the tool 100, such as aboard an offshore unit.

The control device 970 can execute an application and/or firmware using the processor. The application can automate certain aspects of the cutting task, as well as provide various movement controls for placing cuts at locations within the well. In general, this can include the interaction of a GUI for controlling the tools and providing telemetry communication at the surface, instrumentation in electromechanical tools downhole used to machine slots in tubing or casing, and software used to communicate user actions to the tool and enable automated actions. The control device 970 can allow for real-time monitoring of slot cutter sensor data and cut success. Downloadable information can give additional confirmation of finished slots, such as temperature measured near the cut and pressure change data.

The GUI can also be used to visualize other measurements related to the cutting tool 910, such as blade torque, radial arm force, and rotational speed of the blade. One or more sensors in communication with the cutting tool 910 can measure these variables, and others, and provide the information to the control device 970 at the surface. An operator can then use the GUI to make further adjustments or determinations.

In one example, an operator can make adjustments based on the measured blade torque of the cutting tool 910. This can include adjusting a radial arm force of the cutting tool 910, a rotational speed of the blade, or both. As an example, when a measurement of blade torque drops off, this can indicate that the blade is not digging into the material to be cut, and therefore requires additional radial arm force to continue cutting. In another example, if blade torque is rising too high, such as above a threshold level, this can indicate that a higher rotational speed is needed to continue the cutting process.

In some examples, information presented at the GUI can also be used to determine blade wear. As an example, a worn blade can produce lower blade torque than a sharp blade. If the system adjusts arm force and/or rotational speed of the blade and does not detect an appropriate or expected result from those adjustments, then the system can determine that the blade is worn beyond an acceptable amount. In such an example, the GUI can alert the operator that the blade needs to be checked or replaced, such as by displaying an alert or notification.

In yet another example, blade wear can be determined based on the time period between repeating a stage of running the hydraulic pump. For example, if the pump remains off or at a certain setting (such as for maintaining a pressure level for cutting) for longer than a time threshold, this can indicate that the blade is not cutting as quickly as expected. In such an example, the GUI can alert the operator that the blade needs to be checked or replaced, such as by displaying an alert or notification.

The various variables described herein can be applied as inputs to a machine learning model that can generate alerts and notifications and suggest actions for resolving any issues, such as suggesting blade replacement or determining a current level to supply to the hydraulic pump.

As shown in FIG. 9, the system can be deployed with wireline cable 940. The tool 910 can be connected at the end of the wireline cable 940 and lowered into the well either with gravity or using a tractor for highly deviated wells.

The cutting tool 910 can be combined with a linear actuator for elongating slots to increase flow area using a combination of a linear actuator and expandable anchoring mechanism on the opposite side of the linear actuator from the slot cutter. To do this the blades must be indexed by some angular offset between each cutting pass. One way to accomplish this indexing is to use the end-of-stroke approach of the moving and stationary parts of the linear actuator to rotate a piston a small amount at the end of the extend and retract strokes.

Potential applications for this technique of intervention include pressure equalization, bypass of failed valves, access for stimulation treatments, or removal of the tubular for plug and abandonment. The slots can be made using a cutting blade attached to an expandable arm, where the cutting blade rotates in an axis perpendicular to the wellbore axis.

The slot width can be determined by the blade thickness, and depth can be determined by blade diameter. For example, the radial distance between the blade and the protruding hub can act as a stop to limit penetration depth. These dimensions can be selected based on, among other things, tubing thickness. It can be advantageous to extend the length of the slot to increase the area open to flow, or to facilitate some other applications which require the slots to be longer than achievable using radial penetration only. In these cases, the user may wish to cut long slots by cutting radially and moving the cutting blade in the direction of the wellbore axis. The slot could be fully cut before moving the cutter along the wellbore axis, or the slot could be cut partially through the tubing wall and then moved along the wellbore axis.

There are several ways that a force could be applied to the cutter for extending the slot parallel to the wellbore axis. The first is cable tension. Another is force from a linear actuator. For example, the linear actuator can be placed between the cutter and an expandable tubing anchor. The force generated by the linear actuator could be generated by hydraulic pressure acting on a piston or could be generated by rotary motion and a screw.

The control unit can also supply force from a combined linear actuator and anchor, where the anchor is allowed to translate along the body of the tool housing. The force can be generated by hydraulic pressure or motor and screw in an example.

The force can also be generated by hydraulic pressure applied from surface or applied from conveying the cutter on drill pipe or coiled tubing. In one example, the linear actuator can include a position measurement device which can be used by downhole electronics for self-awareness, automation and measuring the position of the cutting blade. As will be discussed, a control unit can provide real-time information to the operator at surface for operational feedback and control. For any of the methods (other than cable tension) the force could be applied to the cutter to extend the slot in either the uphole direction or the downhole direction.

Figure 10:
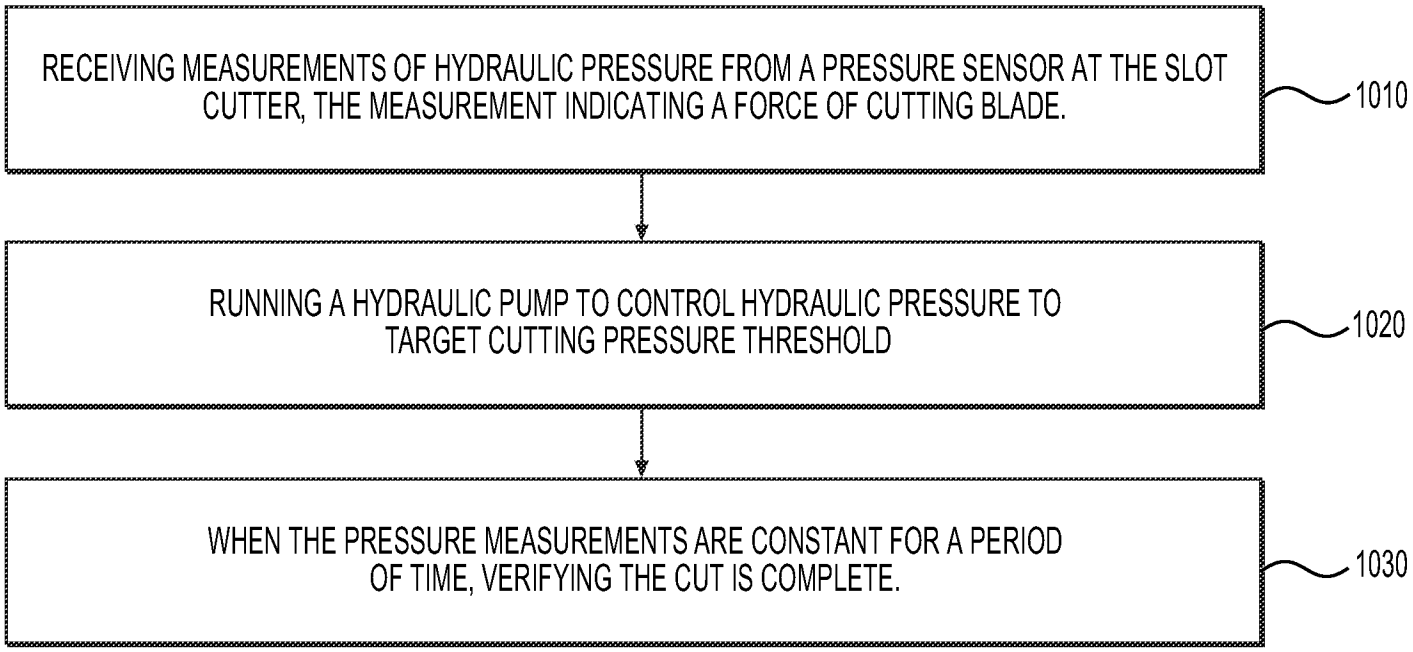
FIG. 10 is a flow chart of an example method for controlling a cut.

FIG. 10 is an example flow chart for controlling a cut. The control device can execute stages for verifying successful progress and completion of cutting downhole slots. In one example, the method can be based on downhole data collected at surface and presented via an acquisition system used to provide real-time communication and control to the tools downhole.

As a parameter for the cutting operation, at stage 1010 the desired arm force required to push the cutting blade into the casing can be sent downhole to the cutting tool(s) from the control device. This arm force can be dictated by the hydraulic pressure supplied from the downhole pump. In one example, this hydraulic pressure can be measured directly by a pressure sensor in the tool to present a real time measurement.

At stage 1020, the control device can monitor the hydraulic pressure in relation to the cut. The hydraulic pump can be turned on to open the cutting arm(s) and can be used to control the hydraulic pressure to a target cutting pressure. For example, the target cutting pressure can be a pressure range, or a particular pressure reading with a margin of error. The hydraulic pump can be modulated such that the target cutting pressure is maintained within the desired range. For example, the hydraulic pump can be modulated by a control unit that receives pressure readings and make changes to the pump to maintain the desired pressure.

At stage 1030, when the cut is nearing completion, the signature on the log can change. The pressure, arm force, and current data channels all become flat, or at least show very reduced slopes. This is indication that the gearbox arm which the blade is mounted to has probably bottomed out on the casing, indicating that the cutting at that location might be complete. When the pressure measurements are constant for a period of time, which can be indicated by the control unit not making adjustments to the pump for that period of time, the cut can be considered to be complete.

To further verify that the slot is complete, the pressure can be increased slightly. If the pressure is increased and the cutting behavior described above returns, then the slot was not yet complete. The process is repeated until the pressure increases no longer induce more cutting.

If the data channels stay flat, then arm is bottomed out and no amount of additional pressure will push the blade further into the casing. The slot is then verified as complete.

The control unit can provide various other information for display on the GUI or for use in making other system determinations. For example, acquisition log indications can be monitored by the user who is operating the tools. The user can adjust inputs based on this signature to successfully cut slots. To take the service a step further, the process can be automated to remove the chance of user error and latency.

For example, an automated system can open the cutting arm(s) to an initial low pressure to start the cut. The arm force can be adjusted automatically, if necessary, until initial cutting behavior is observed. If the automated system observes cutting behavior the parameters can be left as is until the log signature changes.

The control unit can automatically adjust arm force based on elapsed time or instrumentation measurements to always ensure cutting behavior, in an example. Software recognition of slot completion signature and automatic adjustment of arm force can be used to confirm a finished cut.

Automated safety features can also be added to the method to protect equipment and cutting process. For example, the application can confirm that an anchoring method is included in the tool string. The application can prevent start of the cut until an anchoring device is set to prevent movement and damage. For example, the user may be required to articulate the second arm 114 until the bumper 120 engages the side wall of the well.

In another example, the application can prevent cutting until the desired depth (determined by a user or client and controlled by an input parameter from the user) is achieved to avoid cutting slots at the wrong depth.

Other options presented on the GUI to mediate the cutting experience can include a maximum initial arm force to prevent shock load on blade and gearbox, and minimal arm force adjustments allowed between stages. The GUI can also accept blade spin requirements, such as only allowing the blade to be spun in a correct clockwise cutting direction. Other rules can include blades started and spinning before arms are opened against casing ID, keeping blades spinning while arms are closed to prevent stuck blade scenarios, and that the bumper (anchor) cannot be released until cutting process has been stopped.

In addition to the already described slot confirmation method using the data directly from the tools used for slot cutter, there are other methods which can be used to confirm the completion of the cut. For example, a Casing Collar Locator ("CCL") is a depth correlation tool generally used on jobs in a cased hole environment. When the CCL is passed over a section of pipe which has a slot(s) cut in it, the hole(s) can show up as noise on the log signature. Therefore, after each slot(s) is cut in the downhole casing the CCL tool can be moved over the cut section and if the noisy log signature is observed then the slot is further confirmed as complete.

The control unit can also confirm the cut using temperature readings. When a slot is cut in downhole tubing or casing, the cut establishes communication between the two sides of casing. Often the fluids on either side are at different temperatures. There can be temperature sensors on the tool 100 which measure downhole temperature in the borehole. If a change in temperature is observed after the slot(s) is completed, then this is further confirmation of a completed slot and fluid communication between the two sides of the tubing.

The control device can also analyze pressure changes to verify a cut. Pressure differences on the two sides of the pipe usually exist, much like the differences described above for temperature. The tool can include pressure sensors which measure downhole pressure in the borehole. If a change in pressure is observed after the slot(s) is completed, then this is further confirmation of a completed slot and fluid communication between the two sides of the casing.

The GUI of the control device can present any or all these different metrics to the user, in an example. This can allow the user multiple methods of verifying the cut. The GUI can also automatically compare this data to thresholds and present which of the above techniques can verify the present cut.

The data can also be used as inputs to a machine learning model. The model can be trained to detect adequate changes in pressure, temperature, pump current, and other data that together can confidently verify the cut.

Although the control device has been discussed for determining and verifying cut success, the control device functionality can reside and be performed on the tool 100 in an example. Therefore, the examples all also apply to determinations that can be made by the tool itself, in an example.

In one example method, the cutting tool can be used to make an elongated cut. For example, when a cut is complete, an anchor of the cutting tool can be retracted. This can allow for movement within the wellbore. With the anchor retracted, a linear actuator of the cutting tool can be retracted (or extended) to move the anchor and one or more cutting arms of the cutting tool within the wellbore. For example, the cutting arms can be moved such that they are proximate a portion of the wellbore that is only partially cut, or that is adjacent to an existing cut. After being positioned, the anchor can be extended to be set at a new location. A hydraulic pump can then be run to perform a second cut. The second cut can join the first cut, combining into a single elongated cut. This method of extending a cut can be considered an "inch-worm" method of cutting. In another example, the second cut is separate from the first cut with wellbore material separating the cuts.

Figure 11:
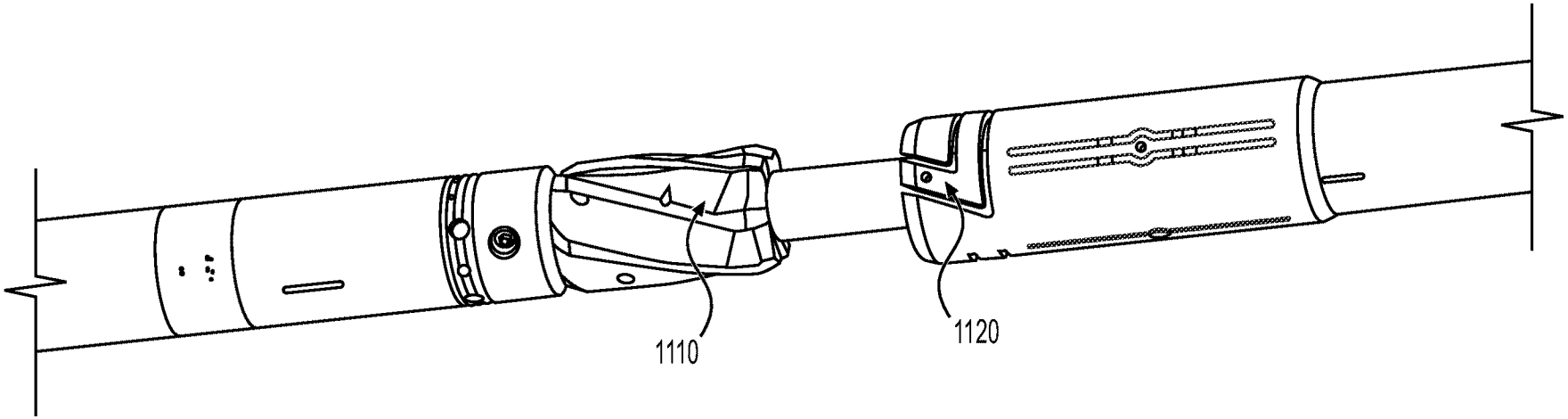
FIG. 11 is a diagram of example components for rotary indexing of the cutting device.

FIG. 11 is an example diagram of components for rotary indexing of a device such as the cutting device described herein. For some applications, it may be advantageous to create a plurality of slots around the tubing circumference at substantially the same depth station. For applications requiring such an arrangement of slots, a device is needed which can rotate the cutting tool around an axis parallel to the wellbore axis. There are several ways that this rotational motion can be accomplished. In FIG. 11, a slotted piece 1120 can swivel over a male piece 1110 with tracks for rotation.

While described in the context of a cutting tool as described herein, the disclosed rotary indexing, including the slotted piece 1120 and male piece 1110, can be used in conjunction with any suitable tool in the context of downhole operations or interventions. For example, the rotary indexing functionality can be applied to tools for performing operations such as drilling, milling, bailing, cutting, welding, lifting, cementing, casing, and retrieval. The discussion below regarding potential uses of the rotary indexing components can be applied to any of these types of tools.

A rotary actuator can be used in combination with an expandable tubing anchor. The rotary actuator, which can include a J slot, can be placed between the cutter device and the anchor, in an example. Alternatively, the rotary actuator and cutter can be on the same side of the anchor on either the uphole or downhole side. The rotary actuator could also be integrated as part of the expandable anchor so that the tool is allowed to rotate within the expandable anchor.

The rotary actuator can be directly driven by an electrical motor or driven through a gearbox to step down the motor speed and increase rotary torque. Alternatively, the rotary actuator can be driven by a hydraulic motor, directly or using a gearbox to change the torque and speed relationship.

The rotary actuator can include an angular position measurement to orient the cutter at a specific orientation relative to other slots, relative to the direction of gravity, or relative to the earth magnetic field.

The rotary actuator could be a combination of motor (electric or hydraulic) and screw. In this embodiment it may also be advantageous to include a device which accommodates axial displacement of the actuator to isolate that axial displacement from the cutter. The rotary actuator could be a spline or wedge that indexes the cutter by a certain angular offset in response to linear motion.

The rotary indexing actuator can use motion of the same device used for elongating the slot, in an example. In one embodiment, a portion of the stroke would be used for elongating the slot and a portion of the linear stroke would be used for generating the rotary motion. The rotary motion portion of the stroke could be accomplished on the linear motion moving downhole, the linear motion moving uphole, or a combination of these movements.

One or more functions described for the control unit can be performed by the tool 100, in other examples. It is to be understood that control unit can communicate with the tool 100 over a wire or wirelessly. Additionally, the tool can utilize combinations of the features discussed herein and is not meant to be limited to a particular combination unless claimed in that combination.

Other embodiments of the invention will be apparent to those skilled in the art from consideration of the specification and practice of the invention disclosed herein. It is understood that the control functionality can be carried out by a processor-enabled device, which can be separate from or part of the slot cutter, depending on the example. Also, the terms slot cutter and cutting device are used interchangeably. It is intended that the specification and examples be considered as exemplary only, with a true scope and spirit of the invention being indicated by the following claims.

What is claimed is:

1. A cutting device for making cuts in a wellbore, comprising:

an elongate tool body for insertion into a borehole;

a first arm including a cutting blade, wherein the cutting blade comprises a side wall and side cutting teeth, wherein an axis of rotation of the cutting blade is substantially at a right angle with respect to an axis of the elongate tool body, and wherein the side cutting teeth protrude outwardly from the side wall in the direction of the axis of rotation; and a second arm, wherein the first and second arms articulate away from the elongate tool body in different directions.

2. The cutting device of claim 1, wherein the second arm comprises a bumper that presses on an opposite side of the borehole relative to the cutting blade.

3. The cutting device of claim 1, further comprising a collar around a portion of the elongate body, wherein the collar extends further than the cutting blade from the axis of the tool body when the first arm is retracted towards the tool body.

4. The cutting device of claim 3, wherein the collar includes grooves on an outer surface for debris passage.

5. The cutting device of claim 3, wherein the collar is located above the first and second arms, wherein the cutting device further comprises a second collar below the first and second arms.

6. The cutting device of claim 1, wherein the cutting blade includes a hub assembly for attachment to a gearbox on the first arm, wherein the cutting blade cuts to a depth based on a difference between a radius of the cutting blade and a radius of the hub assembly.

7. The cutting device of claim 1, wherein the cutting device comprises a communication module that provides real-time communication to a control device located outside of the wellbore, the real-time communication comprising at least one parameter associated with a cut performed by the cutting device.

8. The cutting device of claim 1, wherein the cutting device is coupled to a linear actuator to extend a cut by the cutting blade along a path parallel to the axis.

9. The cutting device of claim 8, wherein the linear actuator is placed between the elongate body and an anchor.

10. The cutting device of claim 1, wherein a rotary actuator rotates the cutting device around the axis.

11. The cutting device of claim 10, wherein the rotary actuator makes an angular position measurement to orient the cutting device radially in the borehole.

12. The cutting device of claim 1, wherein a linear potentiometer measures linear displacement of the cutting device.

13. A method of controlling a downhole cutting tool, comprising:

receiving measurements of hydraulic pressure from a pressure sensor at the cutting tool, the measurement indicating a cutting force;

running a hydraulic pump to control hydraulic pressure to a target cutting pressure; and when the pressure measurements are constant for a period of time, verifying a cut is complete.

14. The method of claim 13, further comprising:

retracting an anchor of the cutting tool;

actuating a linear actuator of the cutting tool to move the anchor to a new location;

setting the anchor at the new location; and running the hydraulic pump to perform a second cut.

15. The method of claim 13, further comprising:

measuring linear displacement as part of determining blade progress of the cutting tool;

measuring current to the hydraulic pump; and as part of verifying the cut is complete, determining the current is changing less than a threshold amount for a time period and determining that the linear displacement has substantially stopped.

16. The method of claim 13, further comprising:

measuring blade torque of the cutting tool; and adjusting a radial arm force and rotations per minute of the blade based on the measured blade torque.

17. The method of claim 13, further comprising determining blade wear for the cutting tool based on arm force and rotations per minute measurements, wherein a graphical user interface alerts the user of a need to replace the blade.

18. The method of claim 17, wherein determining the blade wear includes determining that a period of time before repeating the stage of running the hydraulic pump has exceeded a time threshold.

19. The method of claim 13, further comprising training a machine learning model based on measurements of arm force and rotations per minute, wherein the model is used to determine how much current to supply to the hydraulic pump.

20. A non-transitory, computer-readable medium containing instructions for controlling a downhole cutting tool, the instructions causing a processor to execute stages comprising:

receiving measurements of hydraulic pressure from a pressure sensor at the cutting tool, the measurement indicating a cutting force;

running a hydraulic pump to control hydraulic pressure to a target cutting pressure; and when the pressure measurements are constant for a period of time, verifying a cut is complete.

* * * * *